US005318463A

United States Patent [19]

Broschard, III et al.

[11] Patent Number: 5,318,463

[45] Date of Patent: Jun. 7, 1994

[54] CONNECTOR WITH DIECAST HOUSING AND INTEGRAL KEYS

[75] Inventors: John L. Broschard, III, Harrisburg; Robert H. Frantz, Newville, both of Pa.

[73] Assignee: The Whitaker Corporation, Wilmington, Del.

[21] Appl. No.: 933,266

[22] Filed: Aug. 21, 1992

Related U.S. Application Data

[63] Continuation-in-part of Ser. No. 766,889, Sep. 27, 1991, Pat. No. 5,158,474.

[51] Int. Cl.[5] ..... H01R 13/60

[52] U.S. Cl. ..... 439/540; 439/680

[58] Field of Search ..... 439/359, 362, 607, 608, 439/609, 610, 677, 680, 681, 540

[56] References Cited

U.S. PATENT DOCUMENTS

| | | | |
|---|---|---|---|
| 3,491,330 | 1/1970 | Barnhart et al. . | |
| 3,582,867 | 6/1971 | Thompson . | |
| 3,873,172 | 3/1975 | Paullus | 439/680 X |
| 4,181,391 | 1/1980 | Kilsdonk . | |
| 4,376,565 | 3/1983 | Bird et al. | 439/681 |
| 4,457,575 | 7/1984 | Davis et al. . | |
| 4,795,375 | 1/1989 | Williams | 439/680 |
| 4,822,305 | 4/1989 | Waters | 439/681 |
| 4,832,624 | 5/1989 | Waters et al. | 439/680 |
| 4,842,542 | 6/1989 | Davis | 439/357 |
| 4,895,535 | 1/1990 | Emadi et al. | 439/681 |
| 4,929,184 | 5/1990 | Emadi et al. | 439/681 |
| 4,934,950 | 6/1990 | Green et al. | 439/681 |
| 5,158,474 | 10/1992 | Frantz | 439/680 X |

FOREIGN PATENT DOCUMENTS

| | | | |
|---|---|---|---|
| 2642231 | 7/1990 | France | 439/680 |
| 961714 | 6/1964 | United Kingdom . | |

*Primary Examiner*—Khiem Nguyen
*Attorney, Agent, or Firm*—David L. Smith

[57] ABSTRACT

A keyed electrical connector (2) includes a diecast housing (4) having a front face (20). A keying structure (26) which is an integral part of the housing (4) upstands from the front face (20). The keying structure forms a cylindrical protrusion (28) extending to a distal end (30). The cylindrical protrusions (28) defines an exterior surface having a radially outwardly extending rib (32). The rib (32) extends along at least a portion of the exterior surface of the protrusion (28).

11 Claims, 7 Drawing Sheets

CONNECTOR WITH DIECAST HOUSING AND INTEGRAL KEYS

CROSS REFERENCE TO RELATED APPLICATION

This application is a continuation in part of application Ser. No. 766,889, filed Sep. 27, 1991, and now U.S. Pat. No. 5,158,474.

BACKGROUND OF THE INVENTION

This invention relates to electrical connectors, and in particular to keying structures therefor.

Electrical connectors may be provided with keying structures to permit predetermined pairs of connectors to mate with each other and to prevent the mating of connectors which are not intended to be mated with each other. Keying structures are usually provided on connectors when a plurality of identical connectors are positioned in situ in close proximity to one another so that there is the risk of the wrong connectors being mated therewith. Keying structures do not interfere with the mating of connectors that are intended to be mated with each other but provide interference with the mating of connectors that are not intended to be mated with each other, so as to prevent such mismating.

The keying of connectors is to be distinguished from the polarization of connectors, in that polarization ensures that a first connector which is matable with a second connector is properly oriented relative to the second connector for mating; whereas keying provides a mechanism which permits the mating of connectors which are intended to be mated with each other but prevents the mating of connectors which are not intended to be mated with each other even if they are properly oriented with respect to each other.

U.S. Pat. Nos. 4,822,305 and 4,832,624 disclose keying systems in which a key member is secured to one of the pair of complimentary connectors and is adapted to cooperate with an opposing key member secured in the other connector of the pair.

Each key member is secured in its connector in a selected orientation with respect to its opposing key member so that when the connectors are intended to be mated, extended portions on the key members pass by each other during mating to allow the connectors to mate. If one of the key members is secured in an orientation that is not complimentary to its opposing key member, the extended portions on the key members will engage one another during mating to prevent the connectors from mating. U.S. Pat. No. 4,929,184 disclose a keying system comprising parts which are securable to metal flanges on an electrical connector.

There is disclosed in U.S. Pat. No. 4,934,950 an electrical connector having keying means which are securable in one of a plurality of different angular orientations in a plastic housing.

U.S. Pat. No. 3,491,330 discloses an electrical connector having keying members to each of which a bushing can be locked in one of several possible angular orientations.

According to U.S. Pat. Nos. 3,582,867 and 4,895,535 keying means are securable in one of several possible angularly orientation in a flange of a connector.

U.S. Pat. No. 4,181,391 discloses connectors having keying devices mounted to corresponding flanges of the connectors in one of a plurality of angular orientations.

The connectors are securable together by means of jackscrews surrounded by keying structures.

U.S. Pat. No. 4,457,575 discloses a connector having an insulating housing provided with a metal shield. Keying means are formed integrally with the housing forwardly of the shield.

United Kingdom Patent 961,714 discloses a connector having a multi-part keying assembly removably received in a recess in an insulating housing of the connector. The keying assembly includes a rotatable pin having a hexagonal flange at one end and an axial keying spline at the opposite end of the pin.

SUMMARY OF THE INVENTION

An object of the present invention is to provide an electrical connector having a die cast housing , with a keying structure which is of simple unitary construction and which can, if desired, readily be cast with the housing during its manufacture.

According to the present invention, a keyed electrical connector includes a die cast housing having a front face. A keying structure which is an integral part of the housing upstands from the front face. The keying structure comprises a cylindrical protrusion extending to a distal end remote from the front face. The cylindrical protrusion defines an exterior having thereon a radially outwardly extending rib. The rib extends along at least a portion of the exterior surface of the protrusion.

The protrusion of the keying structure can be received in a complementary hollow key on the front face of a mating connector, the rib of the keying structure being received in an axial keying slot in the wall of the hollow key, provided that the rib and the slot have the same angular orientation. The keying structure can, therefore, be provided on the die cast housing with the keying rib so oriented that the connector having the keying structure can only be mated with a predetermined mating connector. The cylindrical protrusion is preferably formed with an axial tapped bore for receiving a jack screw extending through the hollow key, for drawing the connectors into full mating relationship.

DETAILED DESCRIPTION OF THE INVENTION

Figure 1:
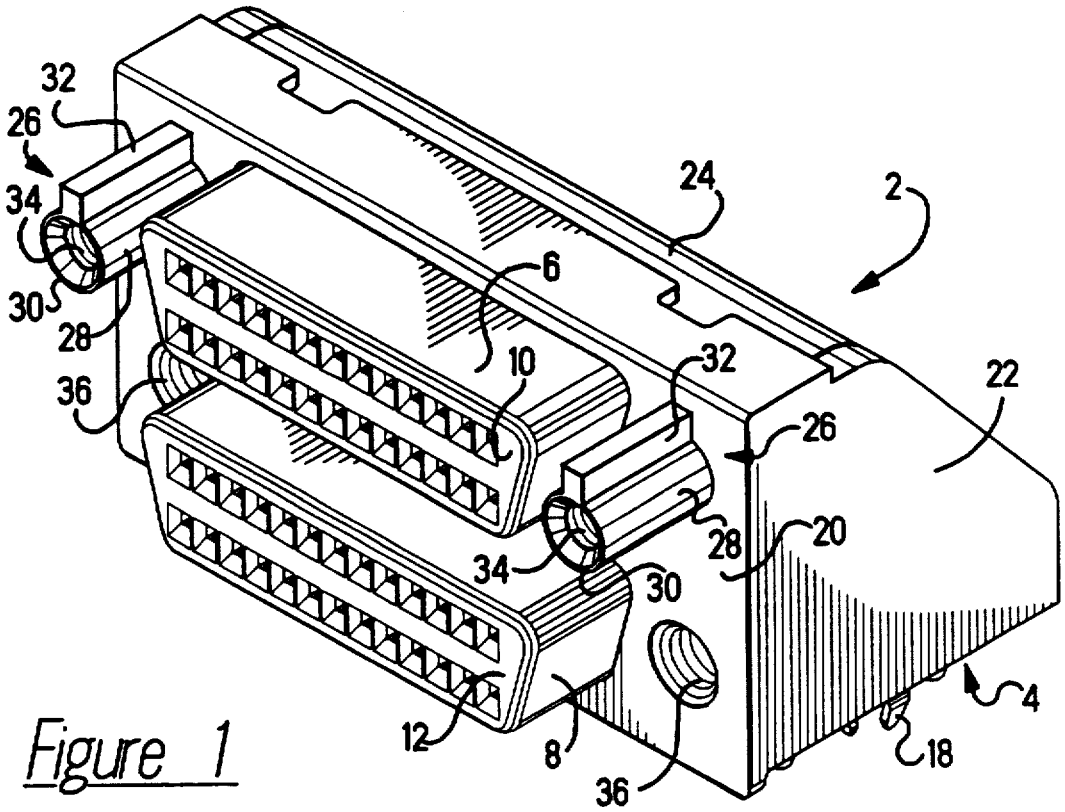
FIG. 1 is an isometric view of an electrical connector having a die cast housing and keying structures projecting therefrom, according to one embodiment of the present invention.
Figure 2:
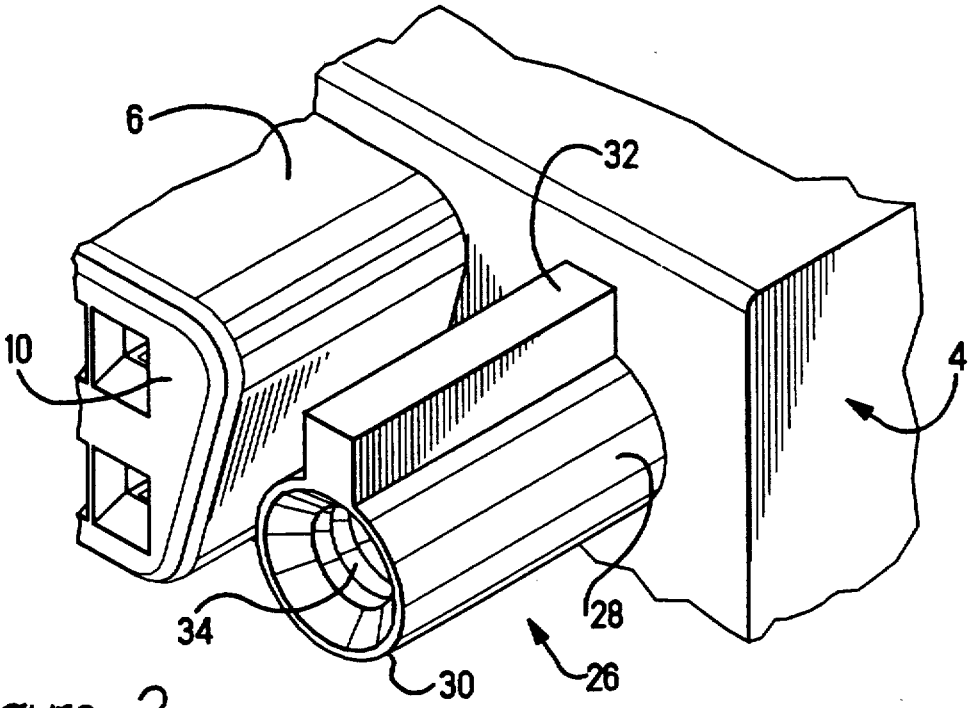
FIG. 2 is an enlarged, fragmentary, isometric view showing a keying structure of the connector of FIG. 1.
Figure 3:
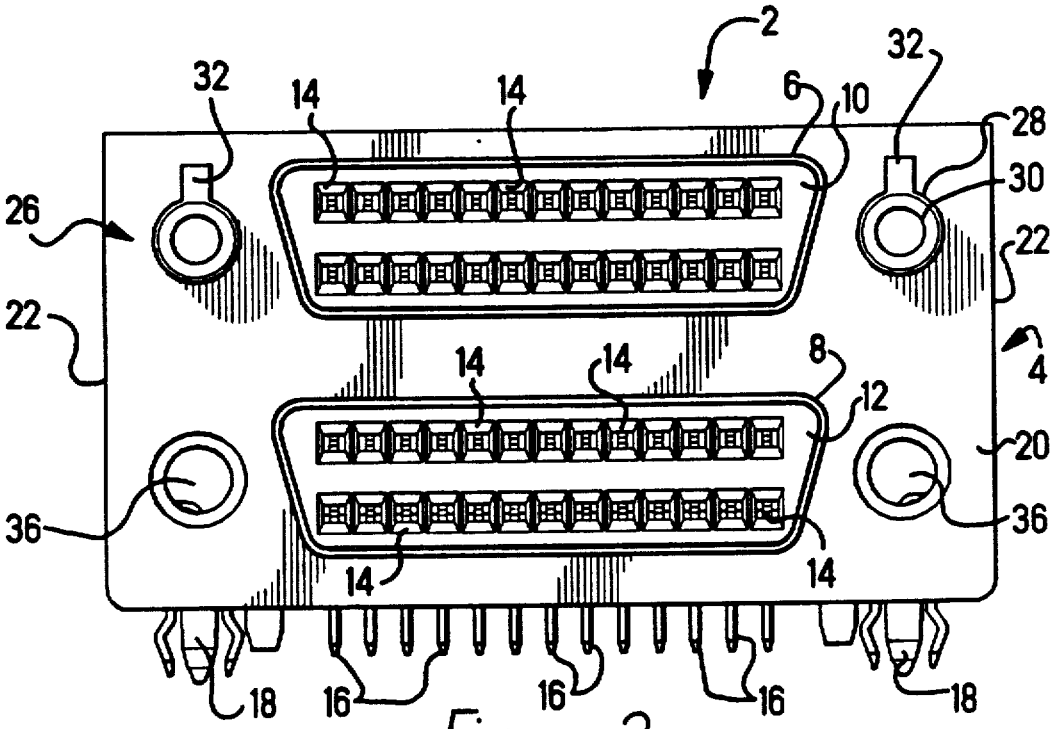
FIG. 3 is a front view of the connector of FIG. 1.
Figure 11:
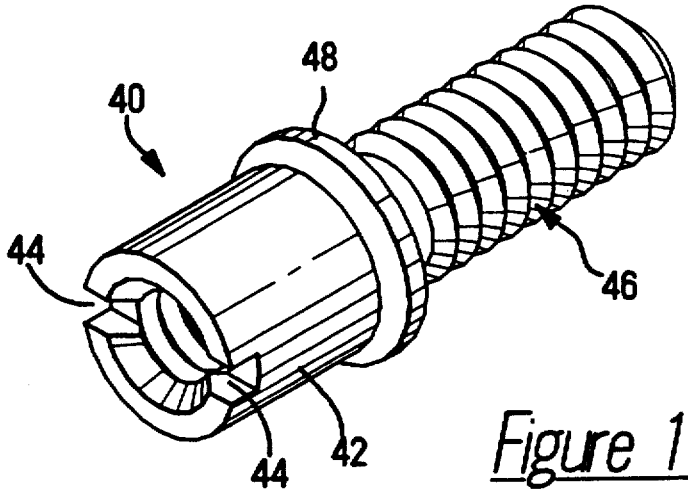
FIG. 11 is an enlarged isomatic view of a screw lock for securing a connector according to FIGS. 1 to 3,4 or 5 to a mounting panel.
Figure 12:
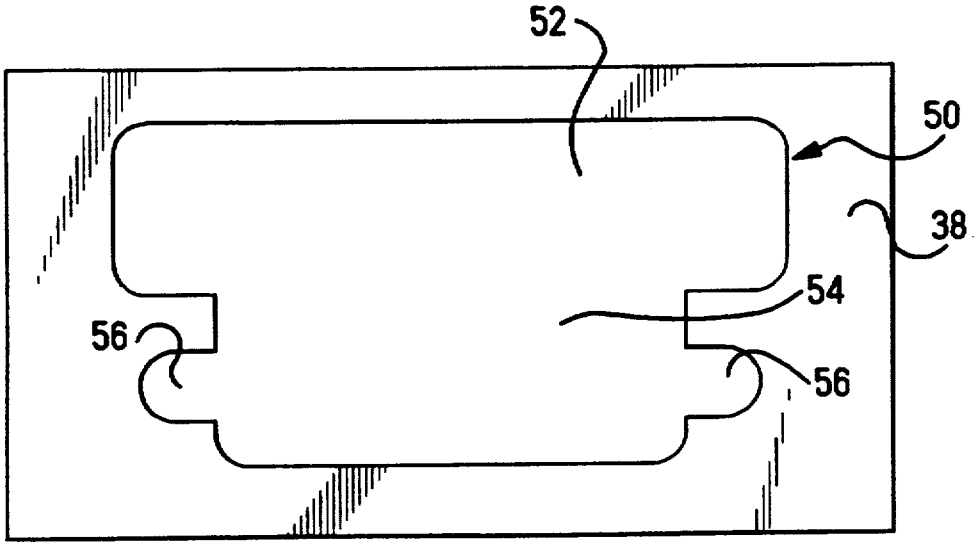
FIG. 12 is a front view of the mounting panel illustrating a connector receiving cut out therein.
Figure 13:
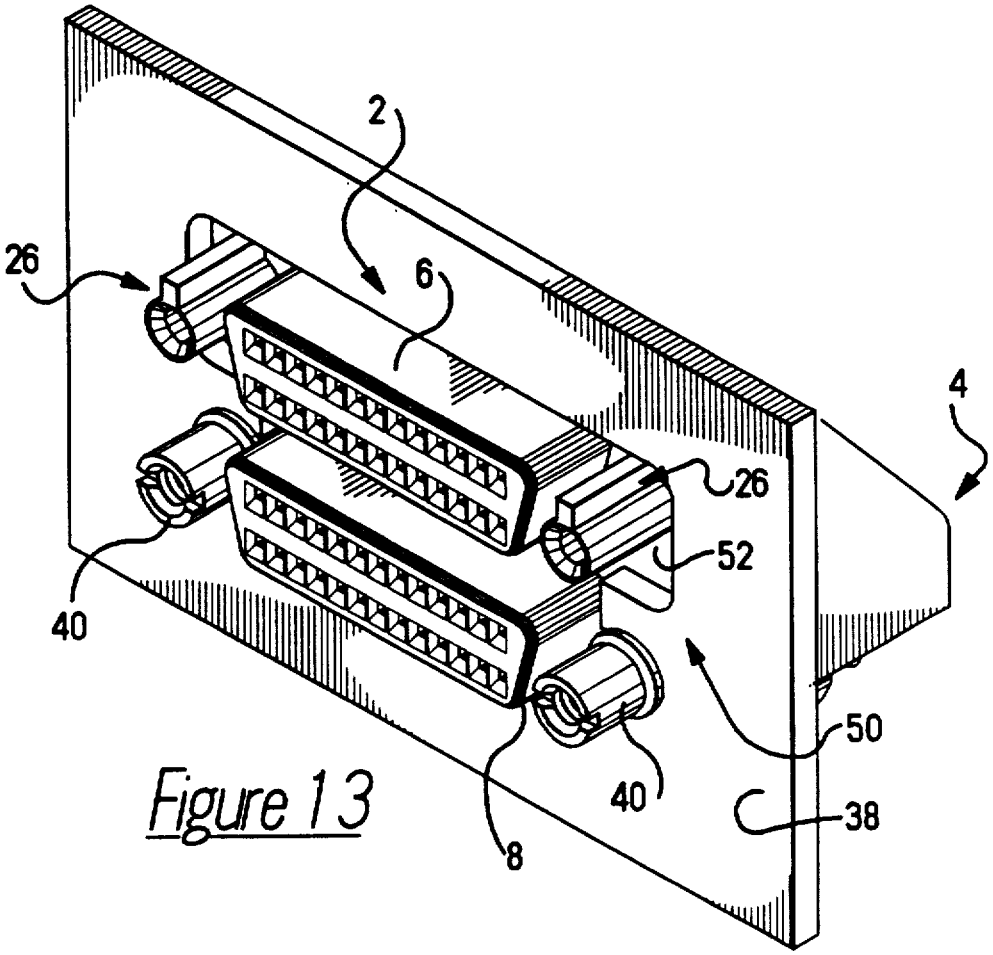
FIG. 13 is an isometric view of the connector of FIGS. 1 to 3, secured to the mounting panel by means of a pair of screw locks according to FIG. 11.
Figure 14:
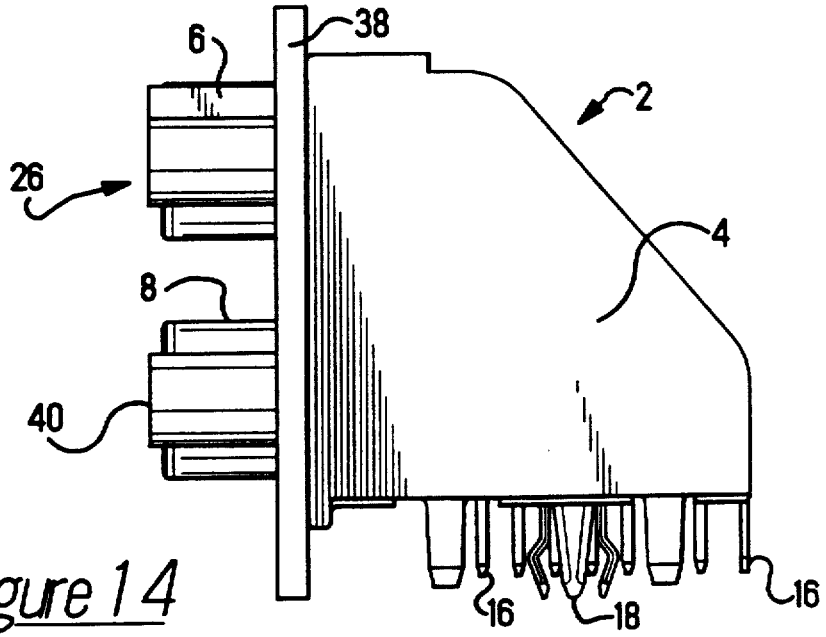
FIG. 14 is an end view of the connector and panel shown in FIG. 13.

FIGS. 1 to 3 show a shielded, right-angle keyed electrical connector for surface mounting on a printed circuit board and being constructed according to the teaching of Patent Application No. 853,649 filed Mar. 18, 1992 (15260) and Patent Application No. 853,565 filed Mar. 18, 1992 (15261), the disclosures of which Patent Applications are hereby incorporated herein by reference. The connector 2 which is according to a first embodiment of the invention, comprises a die-cast metal housing 4 receiving upper and lower drawn metal shells 6 and 8, respectively, which in turn receive insulating upper and lower header inserts 10 and 12, respectively, each accommodating two rows of electrical receptacle terminals 14, having solder tails 16 depending below the housing 4 for reception in holes in the printed circuit board. Board locks 18 depend from the housing 4 for reception in further holes in the printed circuit board to secure the connector 2 thereto. The housing 4 has a front face 20 and side walls 22, between which side walls there is secured a rear metal shield 24 covering those parts of the solder tails which project rearwardly from the housing 4. There projects forwardly from the front face 20, on each side of the metal shell 6, a keying structure 26 comprising a circular cross section, tubular, cylindrical protrusion 28 extending normally of the wall 20 to a distal end 30 remote from the face 20; and a keying rib 32 extending axially of the protrusion 28 and projecting radially outwardly from the exterior surface of the protrusion 28. The protrusion 28 has a tapped, axial bore 34 extending therethrough. The rib 32 may extend from the face 20 to the distal end 30 of the protrusion 28, as shown, or the rib 32 may extend only along part of the length of the protrusion 28. Each keying structure 26 is preferably cast integrally with the housing 4, although the structure 26 may be secured to the housing 4, being, for example, threadingly secured to the front face 20. According to the embodiment of FIGS. 1 to 3, each rib 32 projects radially upwardly and vertically. Below each keying structure 26, on a respective side of the metal shell 8, there is formed in the front face 20 of the housing 4, a tapped bore 36 for receiving a screw lock 40 (best seen in FIG. 11) for securing the connector 2 to a mounting panel 38 which is shown in FIGS. 12 to 14. Each screw lock 40 comprises a circular cross section, elongate head 42 having a kerf 44 at one end for receiving a screw driver blade, and at its other end, a screw threaded shank 46 for meshing with the screw thread of a respective bore 36 of the wall 20 of the housing 4. Between the head 42 and the shank 46, the screw lock 40 has a radially projecting collar 48 for engaging the panel 38.

The panel 38 has a central cut-out 50, best seen in FIG. 12, having an upper part 52 dimensioned to receive the metal shell 6 of the connector 2, as well as the keying structures 26 with substantial clearance thereabout. The cut-out 50 has a lower part 54 dimensioned to receive the metal shell 8 of the connector 2. The part 54 of the cut-out, has opposite lateral extensions 56 each dimensioned to receive the shank 46 of a respective screw lock 40 with sufficiently small clearance to allow the collar 48 of the screw lock 40 to engage the front surface of the panel 38. As shown in FIGS. 13 and 14, the connector 2 is mounted to the panel 38 by inserting the metal shells 6 and 8 through the parts 52 and 54 respectively, of the cut-out 50, from the rear of the panel 38, so that the housing 4 engages the rear face of the panel. In order to secure the connector 2 to the panel 38, the shank 46 of each screw lock 40 is screwed into a respective one of the tapped bores 36 in the wall 20 of the housing 4 until the collar 48 of the screw lock 40 engages against the front face of the panel 38.

Figure 9:
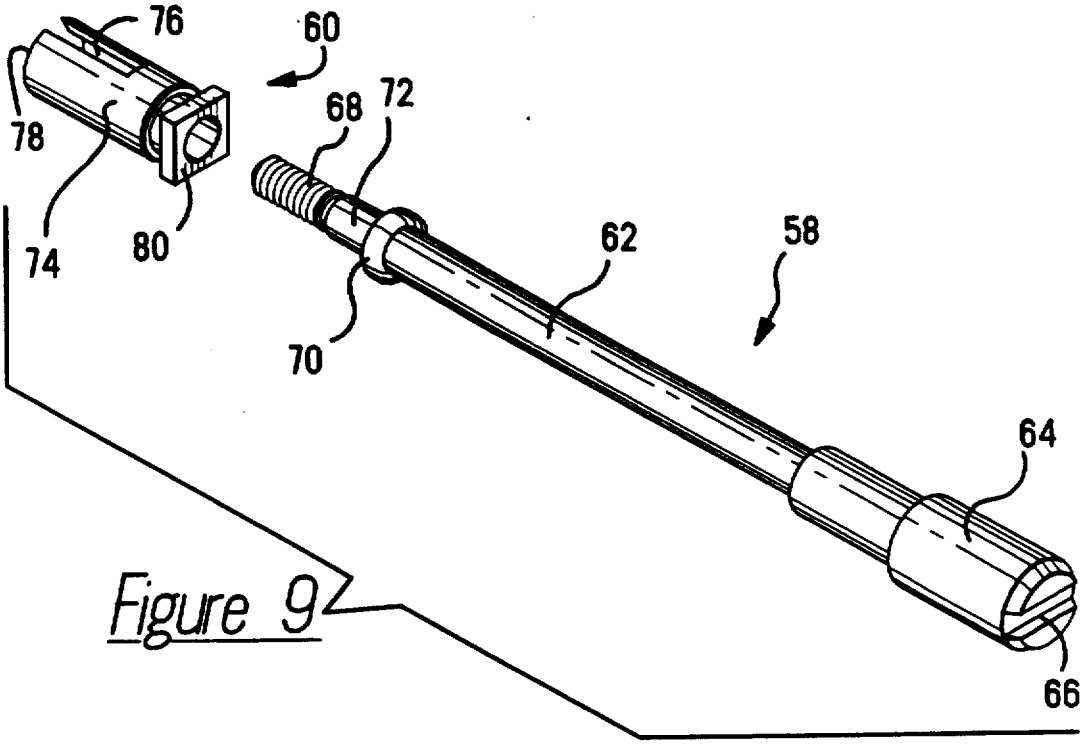
FIG. 9 is an exploded isometric view of a jack screw in combination with a key, for mating with a keying structure of a connector in accordance with the present invention.
Figure 10:
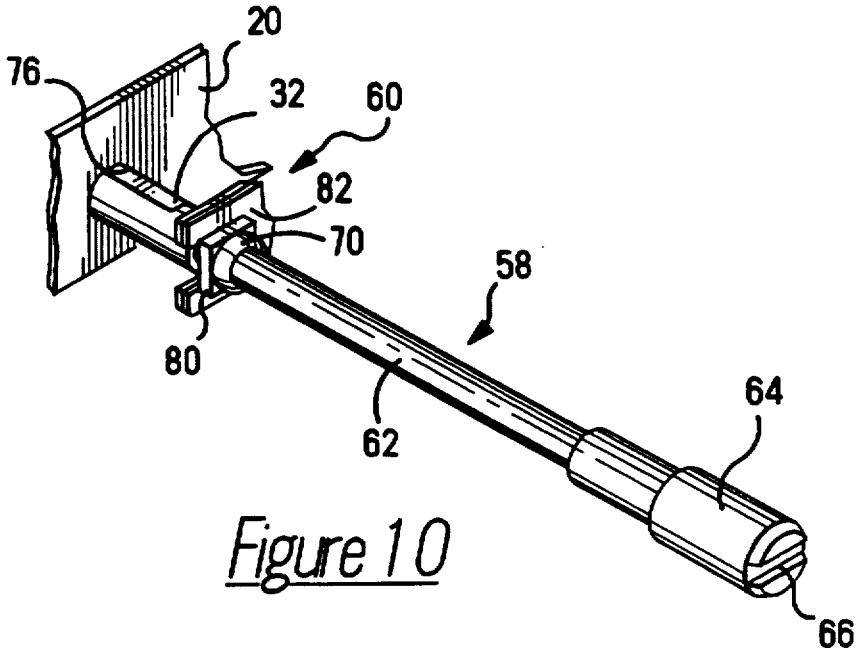
FIG. 10 is an isometric view of the key of FIG. 9 and the jack screw when mated with a keying structure of the connector FIGS. 1 to 3.

The connector 2 is formatting with a further connector (only parts of which are shown) constructed according to the teaching of Patent Application No. 766,889 filed Sep. 7, 1991 (15127), the disclosure of which Patent Application is hereby incorporated herein by reference. The further connector comprises a mating part (not shown) containing pin terminals for mating with the terminals 14 of the header insert 10 of the connector 2 and a back shell structure supporting a pair of jack screws 58, one of which is shown in FIGS. 9 and 10 and a key 60 in the form of a keyed insert, associated with each jack screw 58. Each jack screw 58 has a shaft 62, having at one end a head 64 formed with an end kerf 66 for receiving a screw driver blade, the jack screw having at its other end a screw threaded shank 68. Towards the shank 68, the shaft 62 is formed with a radially projecting collar 70, and is provided intermediate to the collar 70 and the shank 68, a short smooth section 72.

Each key 60 comprises a circular cross-section, hollow, forwardly open, keying shaft 74 having a blind, axial keying slot 76 opening into the forward end 78 of the shaft 74. There extends from the rear end wall of the shaft 74 a neck (not shown), which is hollow and has at its rear end, a four sided keying abutment 80 having a central circular opening communicating with the interior of the neck and with the interior of the keying shaft 74. The key 60 can be supported in said back shell structure of the further connector with the keying abutment 80 and thus the keying slot 76 in any selected one of four angular orientations. In the present example, as shown in FIGS. 9 and 10, the keying abutment 80 is so supported, that the keying slot 76 is in a top dead center angular position.

One of the keys 60 is provided on each side of said mating part of the further connector with the forward ends 78 of the shafts 74 projecting forwardly. Said back shell structure comprises a pair of oppositely laterally projecting slotted flanges 82, one such flange being located on each side of said mating part. Each flange 82 engages about the neck of the respective key 60 between its shaft 74 and its keying abutment 80. The threaded shank 68 of each jack screw 58 lies within the hollow keying shaft 74 of the respective key 60, with the smooth section 72 of the jack screw 58 extending through the abutment 80 and the neck and with the collar 70 of the jack screw 58 engaging against the keying abutment 80 of the key 60.

When the connector 2 has been mounted to the panel 38, as described above, the further connector is mated with the connector 2 to mate the pin terminals of said mating part with the receptacle terminals 14 of the header insert 10 of the connector 2. In order so to mate the connectors, the connector 2 and the further connector are so relatively oriented that the protrusion 28 of each keying structure 26 of the connector 2 is axially aligned with a respective key 60 of said further connector. Since the keying ribs 32 and the keying slots 76 of the respective connectors have the same angular orientation, the keying rib 32 of each structure 36 is thereby aligned with the keying slot 76 of the respective key 60. As the connector 2 and the further connector are being mated, the shank 68 of each jack screw 58 enters the tapped bore 34 of the protrusion 28 of the respective keying structure 26. The jack screws 58 are then tightened so that the threads of the shanks 68 thereof mesh with the threads of the respective bores 34, whereby the protrusion 28 of each keying structure 26 is drawn into the hollow keying shaft 74 of the respective key 60 so that the rib 32 of the protrusion 28 is fully received in the keying slot 76 of the key 60 as shown in FIG. 10. The connector 2 and the further connector are thereby drawn into full mated relationship. Where the keying abutments 80 angularly oriented otherwise than according to the present example, the connectors could not be mated as described above.

The header 12 of the connector 2 could be mated with the mating part of a second said further connector having unkeyed inserts for receiving the screw locks 40.

Other embodiments of the present invention will now be described with reference to FIGS. 4 to 8.

Figure 4:
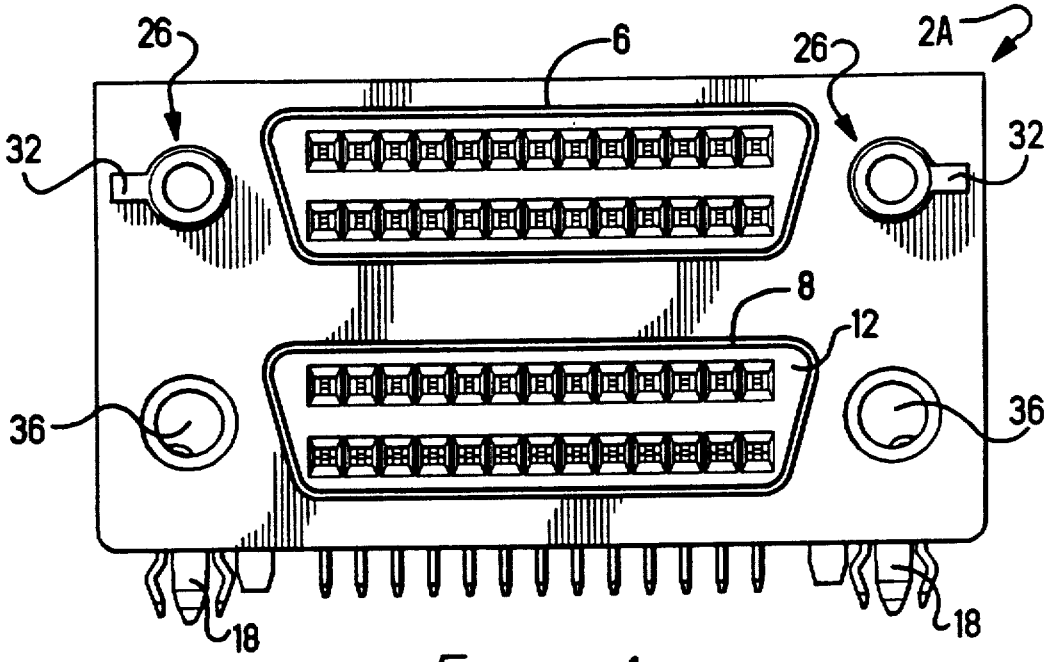
FIG. 4 is a front view of a further embodiment of an electrical connector.
Figure 5:
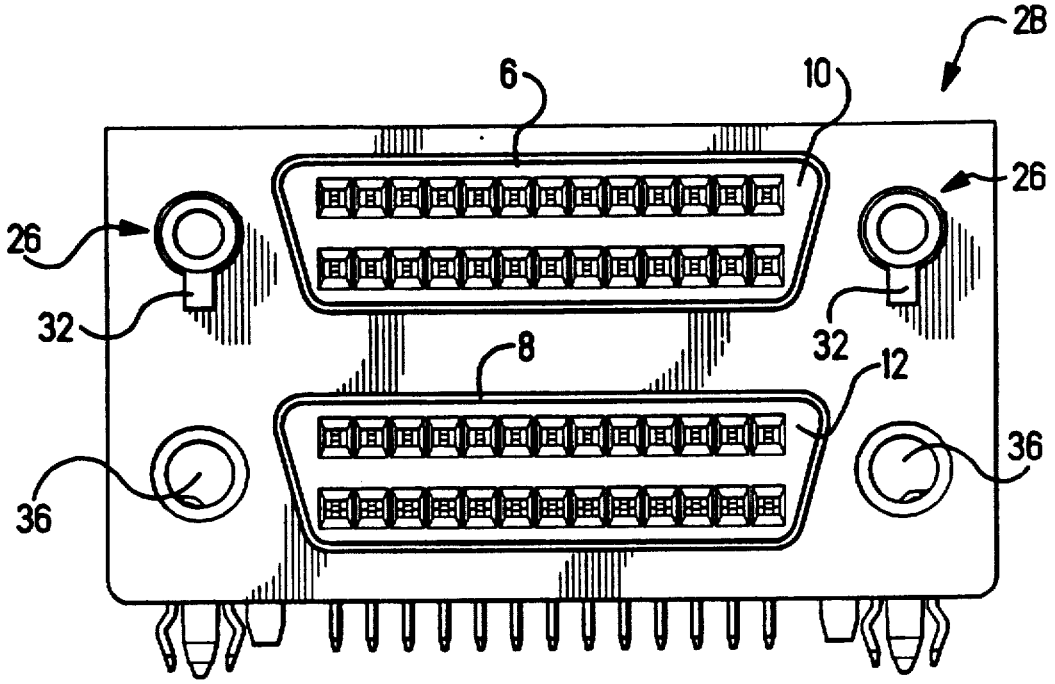
FIG. 5 is a front view of a further embodiment of an electrical connector.

FIG. 4 shows connector 2A which is the same as the connector 2 excepting that the keying structures 26 are so angularly oriented that their keying ribs 32 extend horizontally and in opposite directions away from the metal shell 6. It will be appreciated from the foregoing, that the connector 2A can be mated with said further connector only when the keying abutments 80 thereof are so angularly oriented that the slots 76 of the keys 60 face horizontally and in opposite directions. The connector 2B shown in FIG. 5 is the same as the connectors 2 and 2A excepting that the keying ribs 32 project horizontally downwardly, to take account of the case where the slots 76 of the keys 60 of said further connector are correspondingly angularly oriented.

Figure 6:
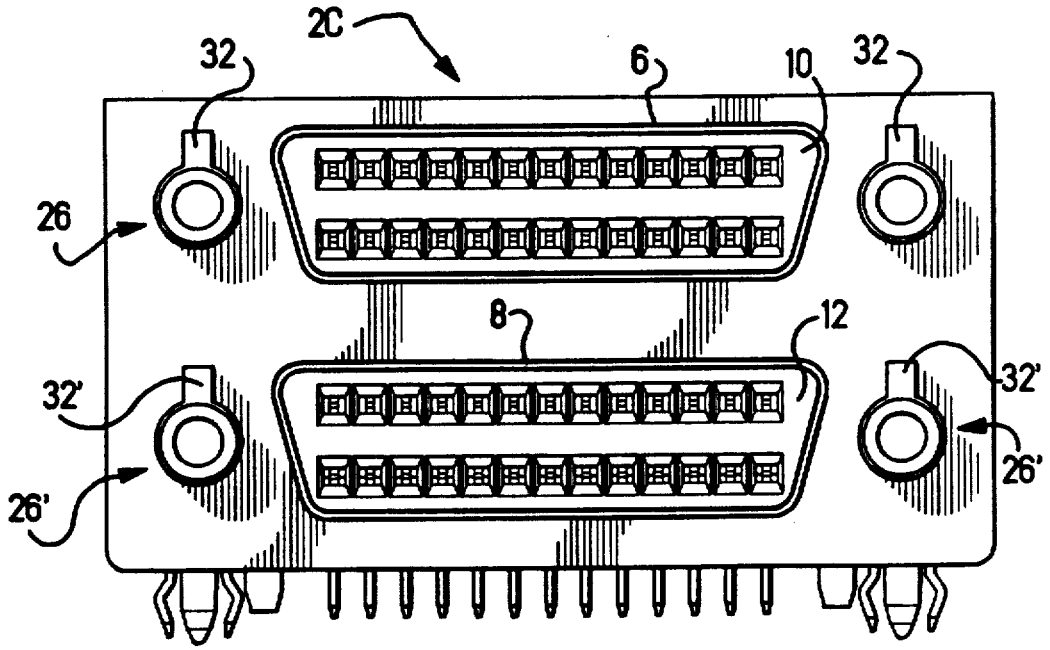
FIG. 6 is a front view of a further embodiment of an electrical connector.
Figure 7:
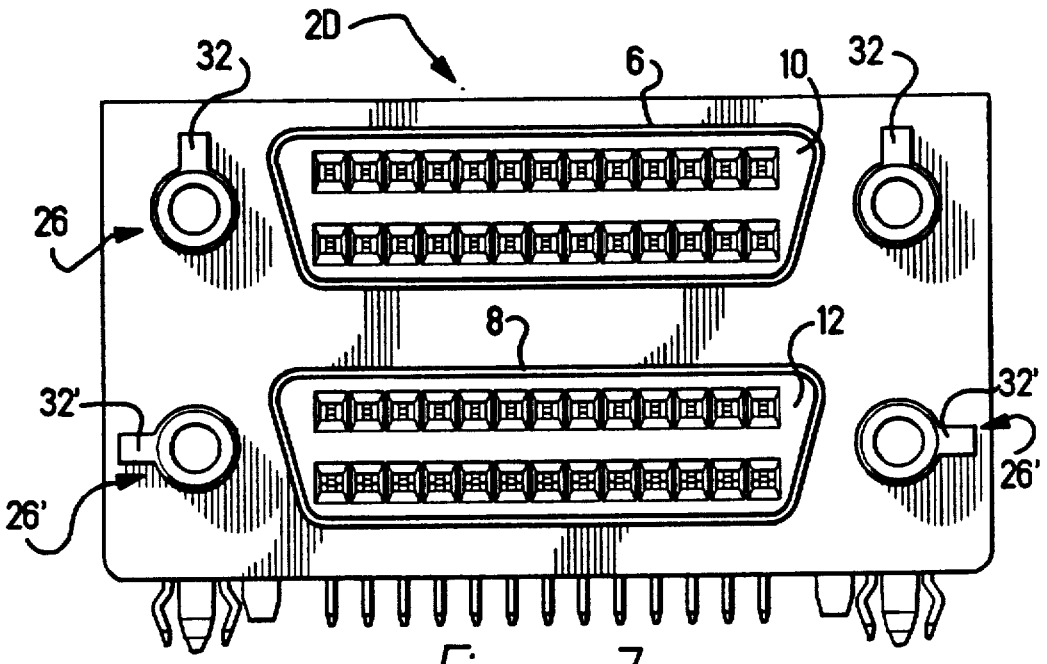
FIG. 7 is a front view of a further embodiment of an electrical connector.
Figure 8:
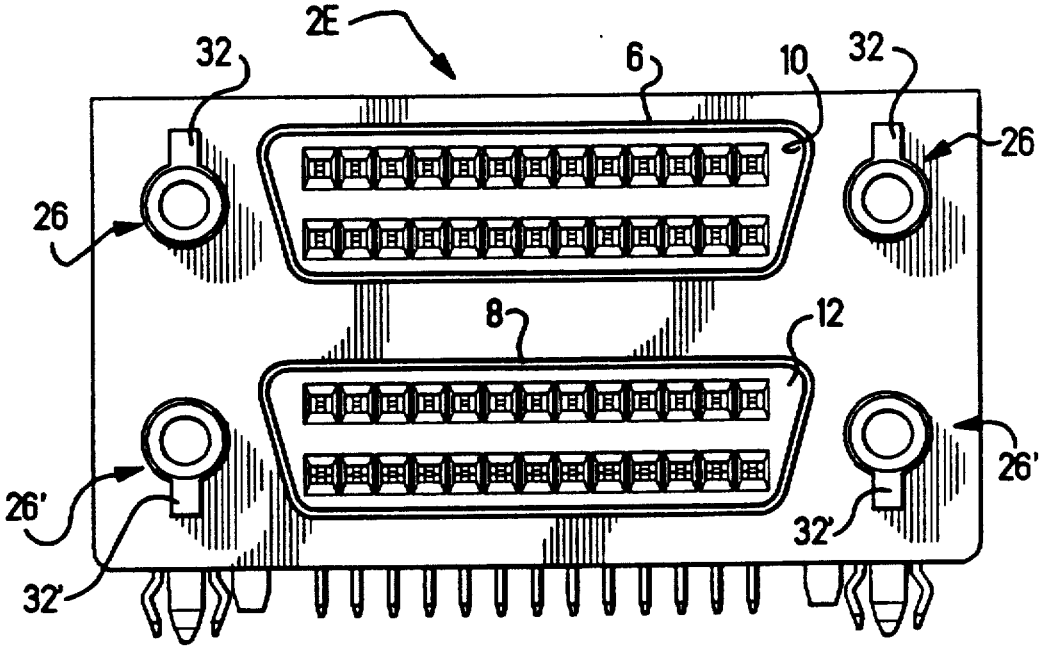
FIG. 8 is a front view of a further embodiment of an electrical connector.

FIGS. 6 to 8 show connectors 2C, 2D and 2E which are the same as the connector 2 excepting that in each case, the connectors 2C to 2E are constructed for mating with two of said further connectors when mounted in stacked relationship. In this case, the connectors 2C to 2E are not panel mounted. The tapped bores 36 for the panel mounting of the connector 2, are replaced, in the embodiments of FIGS. 6 to 8, by keying structures 26', one being disposed on each side of the metal shell 8 for keying with the keys 60 of the lower one of said two further connectors of the stack. In FIGS. 6 to 8, the parts of the structures 26' bear the same reference numerals as the respective structures 26 but with the addition of a ' symbol. As shown in FIG. 6, the keying structures 26' of the connector 2C are angularly oriented in the same way as the keying structures 26 thereof, that is to say with their ribs 32' projecting vertically. As shown in FIG. 7, the keying structures 26' of the connector 2D are differently angularly oriented, by 90 degrees with respect to the keying structures 26, that is to say with their ribs 32/ projecting horizontally and away from the metal shell 8, whereas the keying structures 26/ of the connector 2E are, as shown in FIG. 8, differentially angularly oriented by 180 degrees with respect to the keying structures 26, with their ribs 32/ projecting vertically downwardly, that is to say in the opposite direction to the ribs 32 of the keying structures 26.

It will be appreciated that the keying structures 26 and 26/, as described above, comply with respective possible angular orientations of the keying abutments 80 of the keys 60, which can be adjusted only in 90 degree steps. Nevertheless, as disclosed in said patent application Ser. No. 766,889, the keying abutments 80 could have more than four faces and thus more than four angular orientation. Accordingly, although the angular orientations of the keying structures 26 and 26/, described above, are preferred angular orientations, any required number of different angular orientations of the keying structures would be mathematically possible in dependence upon the number of faces provided on the keying abutments of the further connector or further connectors.

We claim:

1. A keyed electrical connector, including:

a die-cast housing having a front face; and first and second pairs of spaced keying structures each of which is an integral part of the housing and upstands from said front face, each keying structure comprising a cylindrical protrusion extending from said front face, to a respective distal end remote from said front face, each protrusion defining an exterior surface and having a radially outwardly extending rib extending along at least a portion of said exterior surface, the ribs of said first pair of key structures being oriented in a first angular orientation, the ribs of the second pair of key structures being oriented in a second angular orientation which is different from said first angular orientation.

2. A keyed electrical connector as claimed in claim 1, wherein said first and second angular orientations are opposite angular orientations.

3. A keyed electrical connector as claimed in claim 1, wherein said first and second angular orientations are angularly displaced from each other by 90 degrees.

4. A keyed electrical connector, comprising: a cast metal housing, at least first and second insulating inserts containing electrical terminals, the housing having a front face from which protrude keying structures adjacent the first of said inserts, and each of the keying structures being cast with the housing and comprising; a jackscrew receiving, threaded bore along an axis extending through a distal end of each of the keying structures, and a radially projecting keying rib cast integrally with the housing and oriented angularly with respect to said axis to distinguish the first of said inserts from the second of said inserts.

5. A keyed electrical connector as recited in claim 4, further comprising: conductive shells encircling said inserts and being between said inserts and respective keying structures.

6. A keyed electrical connector, comprising: a cast metal housing; at least first and second insulating inserts containing electrical terminals; the housing having a front face from which protrude keying structures adjacent the first of said inserts; and each of the keying structures being cast with the housing and comprising; a jackscrew receiving, threaded bore along an axis extending through a distal end of each of the keying structures, and a radially projecting keying rib cast integrally with the housing and oriented angularly with respect to said axis to distinguish the first of said inserts from the second of said inserts; a panel having a cutout receiving said inserts and the keying structures, extensions of said cutout, and screw lock receiving, threaded bores in the housing adjacent the second of said inserts, the screw lock receiving, threaded bores being aligned with said extensions to receive screw locks for securing the housing to said panel.

7. A keyed electrical connector as recited in claim 6, further comprising: conductive shells encircling said inserts and being between said inserts and respective keying structures.

8. A keyed electrical connector as recited in claim 4, further comprising: threaded bores in the housing adjacent a second of said inserts to receive screw locks for securing the housing to a panel.

9. A keyed electrical connector as recited in claim 8, further comprising: conductive shells encircling said inserts and being between said inserts and respective keying structures.

10. A keyed electrical connector, comprising: a cast metal housing; at least first and second insulating inserts containing electrical terminals; the housing having a front face from which protrude keying structures adjacent the first of said inserts; and each of the keying structures being cast with the housing and comprising; a jackscrew receiving, threaded bore along an axis extending through a distal end of each of the keying structures, and a radially projecting keying rib cast integrally with the housing and oriented angularly with respect to said axis to distinguish the first of said inserts from another of said inserts; additional keying structures adjacent a second of said inserts each of the additional keying structures being cast with the housing and comprising; a jackscrew receiving, threaded bore along an axis extending through a distal end of each of the additional keying structures, and a radially projecting keying rib cast integrally with the housing and oriented angularly with respect to said axis in a direction different than that of said rib of one of the keying structures adjacent the first of said inserts.

11. A keyed electrical connector as recited in claim 10, further comprising: conductive shells encircling said inserts and being between said inserts and respective keying structures.

* * * * *